United States Patent [19]

Doris, Jr.

[11] 3,981,243

[45] Sept. 21, 1976

[54] PROJECTILE

[75] Inventor: Thomas A. Doris, Jr., Palmyra, N.J.

[73] Assignee: The United States of America as represented by the Secretary of the Army, Washington, D.C.

[22] Filed: June 10, 1975

[21] Appl. No.: 585,648

[52] U.S. Cl. ..... 102/52; 102/66

[51] Int. Cl.[2] ..... F42B 13/02

[58] Field of Search ..... 102/6, 52, 65, 66, 90, 102/85

[56] References Cited

UNITED STATES PATENTS

| | | | |
|---|---|---|---|
| 2,975,710 | 3/1961 | Read | 102/66 |
| 3,474,731 | 10/1969 | Thomanek | 102/52 |

FOREIGN PATENTS OR APPLICATIONS

| | | | |
|---|---|---|---|
| 439,023 | 3/1912 | France | 102/85 |

*Primary Examiner*—Verlin R. Pendegrass
*Attorney, Agent, or Firm*—Nathan Edelberg

[57] ABSTRACT

An incendiary projectile containing incendiary mix in its nose portion and an armor piercing penetrator within the projectile and carrying a spirally wrapped, lead sheathed incendiary mix in its peripheral surface. The lead sheath incendiary mix is in contact with the nose portion incendiary mix. The incendiary means are initiated as the penetrator enters the wall of an armored target and portions of the incendiary means burn on both sides of the penetrated target.

2 Claims, 1 Drawing Figure

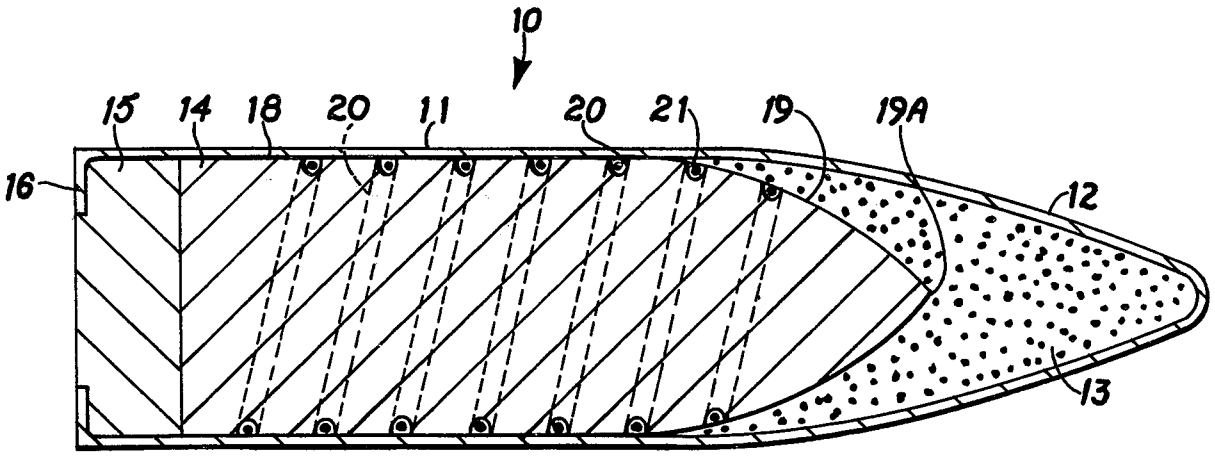
10
11
12
13
14
15
16
18
19
19A
20
20
21

PROJECTILE

The invention described herein may be manufactured, used and licensed by or for the Government for governmental purposes without the payment to me of any royalty thereon.

Heretofore, ineffective incendiary action often occurred due to the absence of incendiary material being delivered behind the target wall.

It is an object of the invention to provide an incendiary projectile having the capability of burning on both sides of an armored target.

Another object of the invention is to provide such a projectile in which incendiary ignition at the target is assured regardless of the angular contact the projectile makes with the target, even if penetration of the target should not occur.

A further object of the invention is to provide such a projectile having a maximum of safety in the assembly thereof.

These and other objects, features and advantages will become more apparent from the following description and accompanying drawing which is a longitudinal section view of a preferred projectile embodying the principles of the invention.

The incendiary projectile, shown generally at 10, has a substantially cylindrical main body portion or jacket 11 provided with an integral forward converging tapered nose portion 12. The forward or nose portion of the projectile is filled with a predetermined amount of incendiary mix material 13 such as magnesium aluminum alloy and potassium perchlorate. An armor piercing core or penetrator body 14 is assembled in the cylindrical portion of the jacket and carefully pressed into the mix material 13 a predetermined amount by means not shown. A rearward end or base plug 15 is inserted and secured against the flat rearward end of the penetrator 14, as by the inwardly directed annular flange 16 suitably formed on the rearward end of the projectile. Preferably, means (not shown) on an associated weapon barrel will impart spin to the projectile upon its launch therefrom.

The peripheral surface of armor piercing penetrator 14 includes a substantially cylindrical surface portion 18 and a forwardly converging tapered surface portion 19 that terminates in pointed end 19A. A substantial part of the penetrator cylindrical peripheral surface 18 has a helical or spiral groove 20 formed therein which extends forwardly somewhat into the converging tapered surface 19. The spiral groove 20 contains a suitable length of lead sheathed incendiary mix material 21, the incendiary mix portion of which is preferably of similar composition as the nose portion mix 13 that is in contact with the forward end of the lead sheathed member 21. The lead in the latter provides support to the enclosed incendiary material, as well as a certain amount of lubricity that prevents premature initiation of the incendiary during assembly of the round.

Preferably, the rearward end of the projectile is assembled in the mouth of a suitable propellant charge containing cartridge case (not shown) by an appropriate crimping action well known in the art.

Upon launching of the spinning projectile from the weapon barrel and subsequent contact with a target such as a fuel tank, the jacket wall will rupture to ignite incendiary mix 13 and, as the penetrator 14 pierces the target wall, the lead sheathed incendiary mix is ignited by either or both the ignited incendiary mix 13 and/or the friction of the fragmented target wall being penetrated. As the spining penetrator 14 advances through the target wall, centrifugal force tends to separate the lead sheathed incendiary mix 21 from its groove 20 to facilitate ignition of fuel or other behind the target material.

Various modifications, changes or alterations may be resoted to without departing from the scope of the invention as defined by the appended claims.

I claim:

1. An incendiary projectile comprising, a projectile main body having a forward nose portion and a rearward annular flange, said nose portion containing an incendiary mix, a base plug secured in said main body against said annular flange, a penetrator positioned within said main body forwardly adjacent said base plug, said penetrator having a spiral groove in its peripheral surface, and a lead sheathed incendiary mix in said groove and in contact with said nose portion incendiary mix.

2. The structure in accordance with claim 1 wherein said penetrator peripheral surface includes a cylindrical surface portion and a forward converging tapered surface portion, each of said surface portions containing a portion of said lead sheathed incendiary mix.

* * * * *